US005938381A

United States Patent [19]

Diehl et al.

[11] Patent Number: 5,938,381

[45] Date of Patent: Aug. 17, 1999

[54] METHOD AND TOOL FOR CREATING A CONCAVE SURFACE FROM A SPECTACLE BLANK

[75] Inventors: Joachim Diehl, Giessen-Allendorf; Ronald Lautz, Huettenberg; Karl-Heinz Tross, Ehringshausen, all of Germany

[73] Assignee: LOH Optikmaschinen AG, Germany

[21] Appl. No.: 08/695,789

[22] Filed: Aug. 12, 1996

[30] Foreign Application Priority Data

Aug. 12, 1995 [DE] Germany ..... 195 29 786

[51] Int. Cl.[6] ..... B23C 9/00

[52] U.S. Cl. ..... 409/132; 409/131; 409/165; 409/197; 451/42; 451/137; 451/140

[58] Field of Search ..... 451/42, 137, 140, 451/146; 409/131, 132, 138, 165, 197, 199

[56] References Cited

U.S. PATENT DOCUMENTS

| | | | |
|---|---|---|---|
| 3,212,405 | 10/1965 | Smith . | |
| 3,704,554 | 12/1972 | Laughman | 451/42 |
| 3,866,358 | 2/1975 | Rupp . | |
| 3,877,177 | 4/1975 | Taniguchi . | |
| 3,902,277 | 9/1975 | Rupp . | |

(List continued on next page.)

FOREIGN PATENT DOCUMENTS

| | | |
|---|---|---|
| 0 453 627 A3 | 10/1991 | European Pat. Off. . |
| 30 35 536 A1 | 4/1981 | Germany . |
| 31 25 915 A1 | 1/1983 | Germany . |
| 42 21 377 A1 | 1/1993 | Germany . |
| 42 30 979 A1 | 3/1993 | Germany . |
| 42 10 381 A1 | 10/1993 | Germany . |
| 93 03 054 | 5/1994 | Germany . |
| 2 058 619 | 4/1981 | United Kingdom . |
| WO 92/00832 | 1/1992 | WIPO . |

OTHER PUBLICATIONS

Opposition letter of Messrs. Optische Werke C. Rodenstock dated Jun. 6, 1997 (Opponent I).

Opposition letter of Messrs. Gerber Optical, Inc. dated Jun. 6, 1997 (Opponent II).

Opposition letter of Messrs. Coburn Optical Industries Inc. dated Jun. 5, 1997 (Opponent III).

Affidavit of Raymond D. Gregory filed by (Opponent III).

The paper filed by applicatant Loh Optikmaschinen AG on Nov. 5, 1998 in response to the three oppositions.

"Tech Bulletin SG–8 Surface Generator Software Revision C.08 Description"; Mar. 24, 1994.

"SGX Surface Generator—Software Release Description"; Software Revision B.23; Jun. 16, 1994, Gerber Optical, Inc.

Bedeutung der Sonderwerkzeuge—Anwendungbeispiele für Serien mit mitteren Stückzahlen, Maschinenmarkt, Wurzbur, 82 (1976) 86, p. 1577–1580.

*Primary Examiner*—Steven C. Bishop
*Assistant Examiner*—Adesh Bhargava
*Attorney, Agent, or Firm*—McAndrews, Held & Malloy, Ltd.

[57] ABSTRACT

A method for creation of a surface from a rough blank for spectacles is which is suitable for both brittle-hard materials and for plastics uses makes use of a disk-shaped, rotation-symmetrical tool of relatively large diameter, by means of which the material to be taken off the rough blank is removed with high grinding or milling efficiency in at least two work steps—a plunge-cut step and a shaping step with material removed along a spiral path. The outcome of the last work step is a machining path traveling in a spiral from the outside to the inside with low residual apex height and relatively large apex spacing. The resulting surface needs only slight fine-grinding and polishing aftertreatment. As an option, both a rim machining step adapted to the form of the eyeglass frame and a work step faceting the rim of the eyeglasses can be integrated into the method. Furthermore, tools are proposed for carrying out the grinding and milling process.

5 Claims, 9 Drawing Sheets

U.S. PATENT DOCUMENTS

| | | | |
|---|---|---|---|
| 4,177,699 | 12/1979 | Dovnar et al. | 409/132 |
| 4,363,193 | 12/1982 | Herzig | 409/199 |
| 4,680,998 | 7/1987 | Coucil, Jr. | 451/42 |
| 4,760,672 | 8/1988 | Darcangelo et al. | 451/42 |
| 4,856,234 | 8/1989 | Goins | 409/131 |
| 4,862,646 | 9/1989 | Briones | 451/42 |
| 4,866,884 | 9/1989 | Smith et al. | 451/42 |
| 4,989,316 | 2/1991 | Logan et al. | 451/42 |
| 5,195,407 | 3/1993 | Takeno et al. | 451/42 |
| 5,231,587 | 7/1993 | Frost . | |
| 5,402,607 | 4/1995 | Lombard . | |
| 5,485,771 | 1/1996 | Brennan et al. . | |
| 5,545,075 | 8/1996 | Gottschald . | |

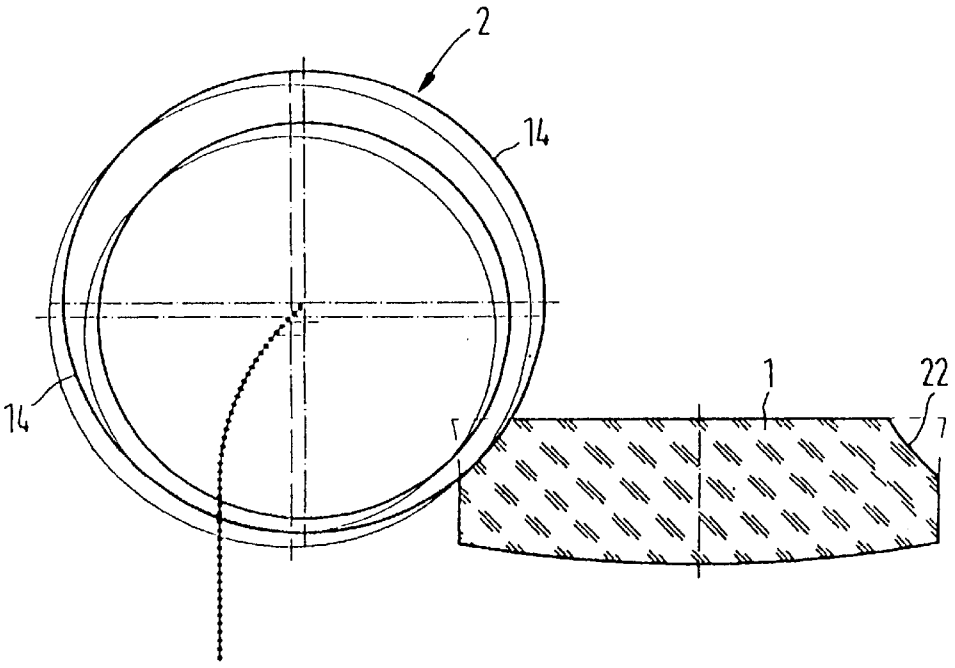
FIG. 9
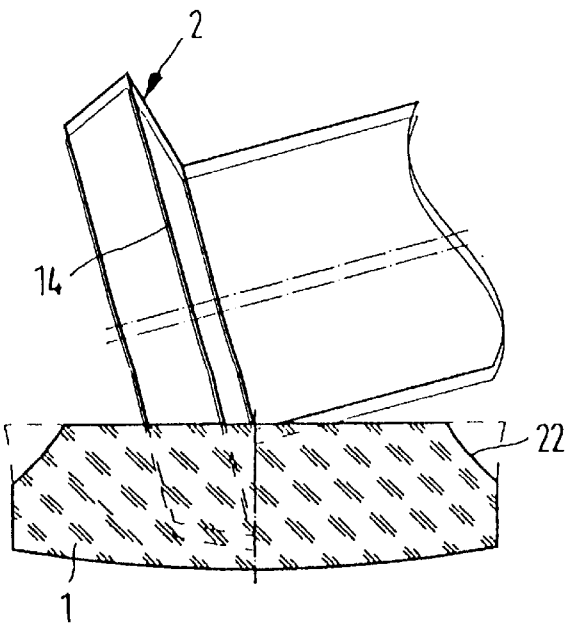

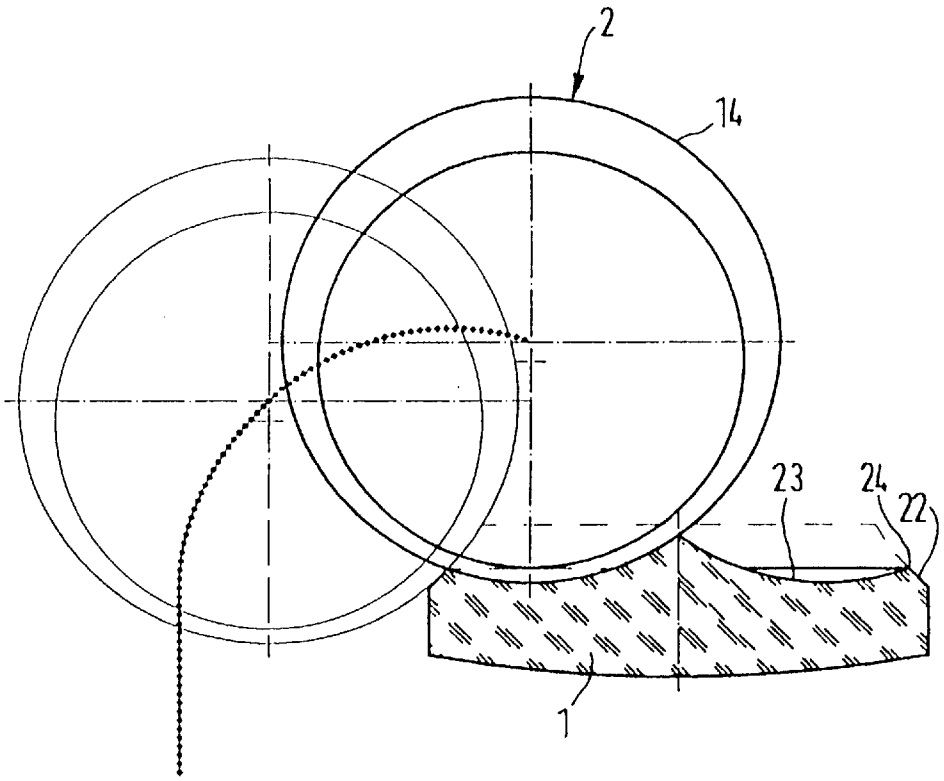
FIG. 10
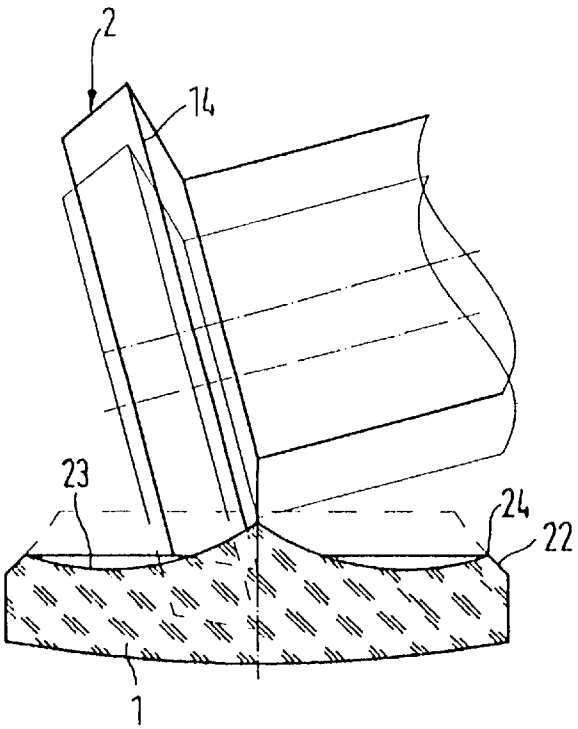

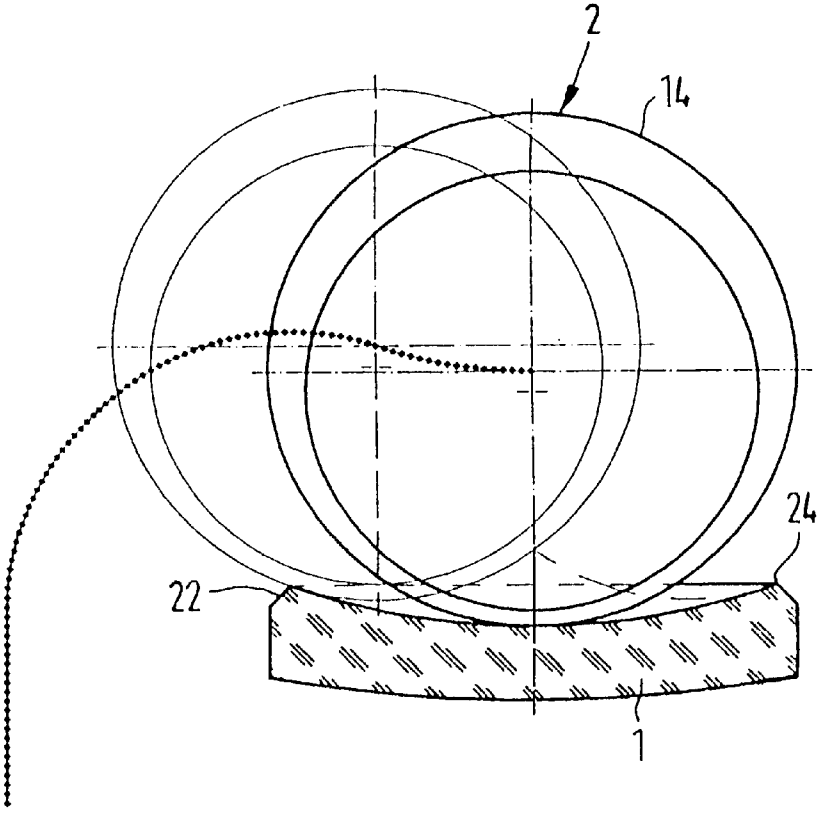
FIG. 11
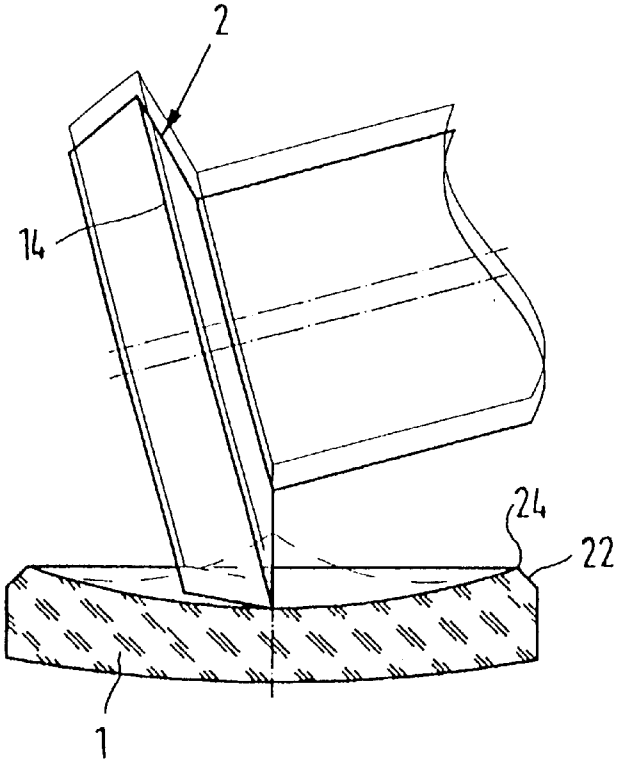

METHOD AND TOOL FOR CREATING A CONCAVE SURFACE FROM A SPECTACLE BLANK

FIELD OF THE INVENTION

The invention concerns a method for creating a concave surface from a rough blank for spectacles and tools for carrying out the method on brittle-hard and plastic blanks for eyeglasses.

BACKGROUND OF THE INVENTION

In a familiar method of the kind indicated at the outset (DE 42 10 381 A1), the tool and the workpiece are controlled during the entire process sequence so that the removal of material occurs exclusively along a spiral path. Although this method makes it possible to shape the concave surface, (which already largely conforms to the finished surface of the lens), this method provides poor cutting performance. If larger amounts of material are to be removed from the workpiece, the workpiece and tool have to be moved relative to each other many times along a spiral path, which results in undesirably long machining times when manufacturing eyeglasses by prescription.

SUMMARY OF THE INVENTION

Hence, an objective of the present invention is to provide a method for creating concave surfaces on a rough blank for spectacles by which it is possible to machine precisely and economically both brittle-hard materials and plastic materials with high cutting performance to produce all conventional concave surface shapes of spectacle optics, with the outcome of a uniform surface quality and short machining times. A further object of the present invention is to provide tools which are especially suitable for carrying out the method.

These and other objects and advantages are achieved by a method for creating a concave surface on a rough blank for eyeglasses (workpiece), by a milling or grinding tool, in which the blocked-up workpiece and the tool are moved relative to each other in a CNC-controlled machining process with two linear axes of motion (x and y axis) and two axes of rotational movement making an angle ($\alpha$) to each other: A first axis (the "b-axis") is assigned to the workpiece and the other axis (the "c-axis") is assigned to the tool. Removal of material to shape the surface is done along a spiral path on the surface, in that the tool and the workpiece are moved relative to each other along the x, y and b axes. A disk-shaped rotation-symmetrical tool is used as the tool and is arranged such that the lowest point of the tool in relation to the workpiece is situated in a plane defined by the b and x axes. Removal of material along the spiral path is preceded by a plunge-step, during which the workpiece rotates about its axis (b) and the tool is moved at least in the direction of the y-axis, until a surface in the shape of an annular trough is achieved, the concave surface being created at least in the region of the outer rim of the workpiece, so that the surface produced on the workpiece at least in the region of the outer rim corresponds to the nominal outer contour of the optically active inner surface of the eyeglass.

Dividing of the processing method into two work steps, namely, a first plunge-cut process and a second process with removal of material along a spiral path, results in very short machining times. In the plunge-cut step, very high cutting or grinding rates are possible, so that the main bulk of the blank material to be removed is quickly taken off. The continuous plunge or infeed step spares the multiple cuts which are necessary in the known technique in the case of a thick blank. Already during the plunge-cut, at least in the region of the outer rim, a surface is achieved which corresponds to the nominal outer contour of the optically-active inner surface of the eyeglasses.

The method according to the invention makes it possible to create high-precision surfaces for all conventional surface shapes of spectacle optics, namely, toroidal, prismatic, off-center, multifocal or nontoroidal surfaces on glass and plastics.

Preferably, a rim machining step is integrated into the method, whereby one can produce not only thin comfortable eyeglasses, but also shorten the work time for the later fitting of the eyeglasses into the frame with less wear on the tool on the part of the eyeglass maker. The user of the method has the advantage of a smaller inventory of semifinished glasses of different diameters. If the three work steps of rim machining, plunge-cut, and machining along the spiral path are undertaken in continuous sequence, very short production times can be achieved. These work steps can be carried out in a single clamping or blocking of the workpiece.

If the peripheral edge of the workpiece is supposed to be provided with a facet, it is also possible to incorporate a faceting step in the process sequence so that when undertaking a rim machining step a total of four immediately consecutive work steps are carried out with only one clamping or blocking of the workpiece.

A grinding tool for carrying out the method on a brittle-hard spectacle glass blank is very advantageous because of the special configuration of the grinding lip, since the blade geometry remains constant, even when undergoing wear. Only the diameter of the tool is reduced by wear, yet this can be easily compensated by measuring the thickness of the ground glass and then allowing for it in the control program.

A milling tool for carrying out the method on a plastic spectacle blank is disk shaped in respect of its form of rotation, and individual milling cutters are distributed about the periphery. The cutting performance of this milling tool, in which the blades define a toroidal envelope surface, is high. The lifetime of the milling cutters can be advantageously enhanced if the cutting plates of the milling tool containing the blades are mounted so that they can be rotated. In this way, several successive regions of the cutting plate can be twisted into a working position before the cutting plates have to be replaced on account of wear, or their outer diameter has to be touched up.

BRIEF DESCRIPTION OF THE DRAWINGS

The invention shall be explained more closely hereafter, making reference to the basically schematic drawings which show:

FIG. 9 shows the tool and workpiece during the faceting step, in two views, similar to FIG. 8.

FIG. 10 shows the tool and workpiece during the plunge-cut step, in two views, similar to FIGS. 8 and 9.

FIG. 11 shows the tool and workpiece during the work step with machining along the spiral path, in two views similar to FIG. 8, 9 and 10.

DETAILED DESCRIPTION OF THE PREFERRED EMBODIMENT

Figure 1:
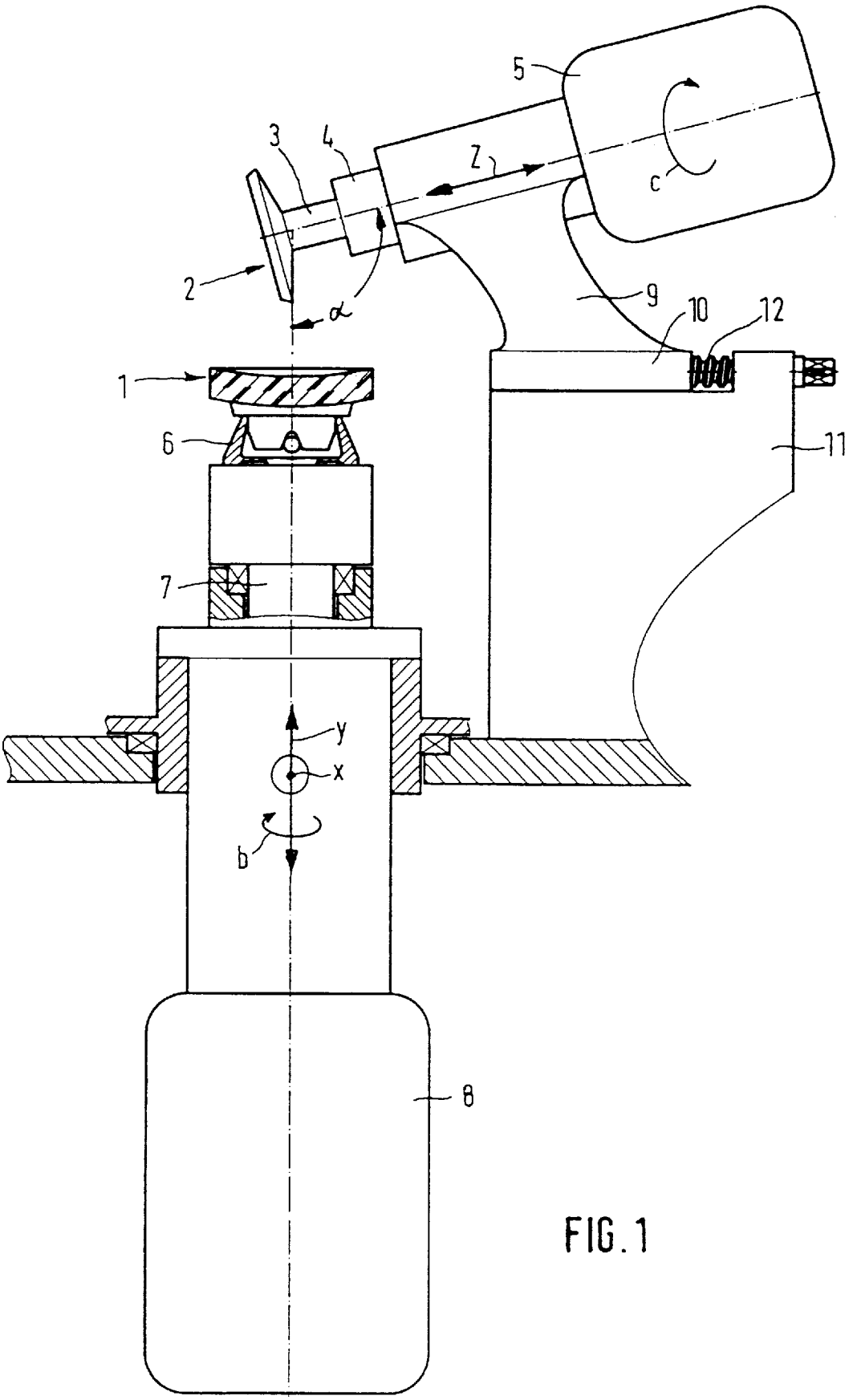
FIG. 1 is a partly cutaway side view of a milling and grinding machine for eyeglasses.
Figure 2:
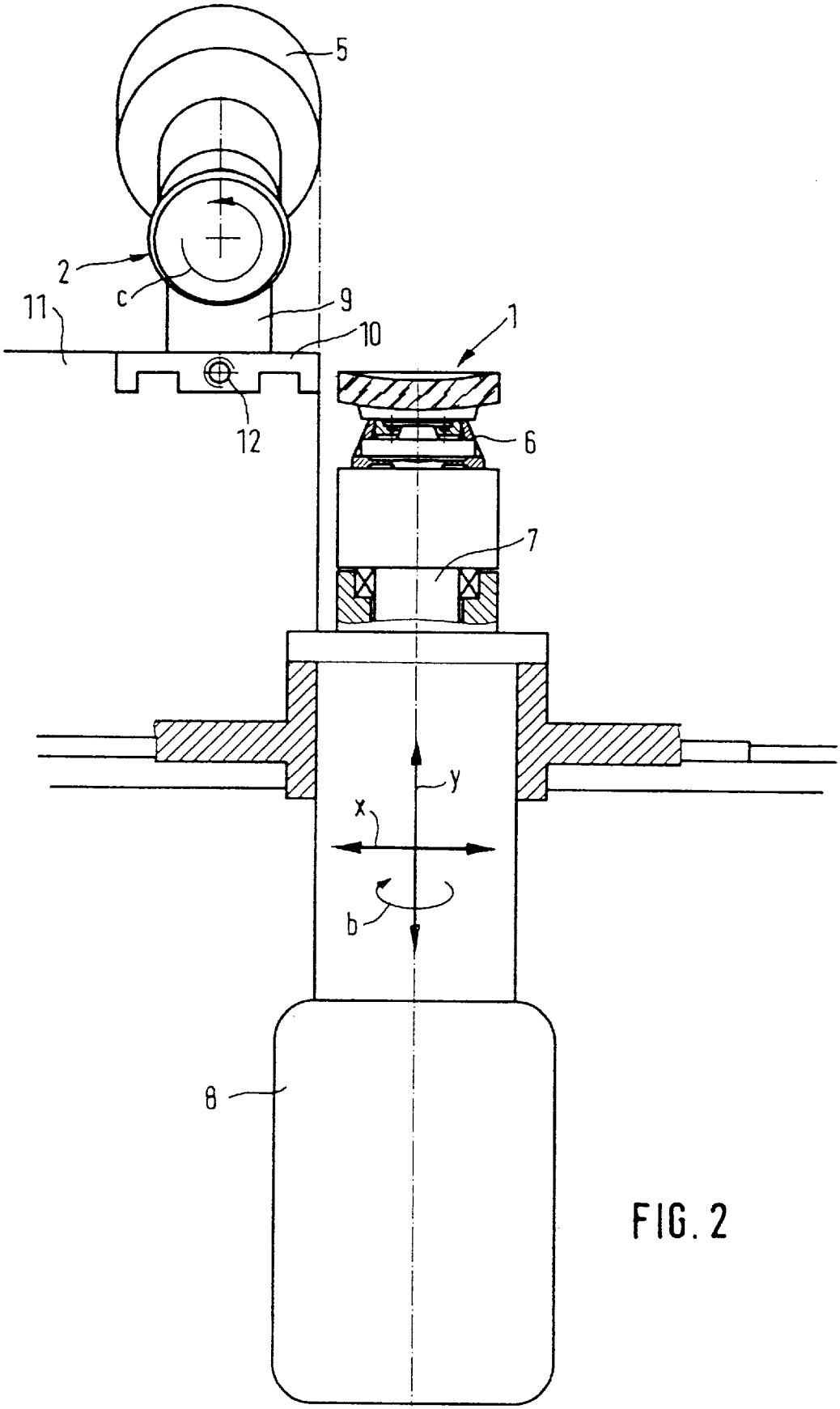
FIG. 2 is the front view of the machine of FIG. 1.

For simplicity, FIGS. 1 and 2 show only the parts of the grinding or milling machine which guide and drive or carry the workpiece 1 and the tool 2, respectively. The tool 2 is secured via a shaft 3 coaxially on a spindle 4, which is caused to rotate via an electric motor 5 with adjustable speed. The workpiece 1 is set up on a work holder 6, which is fastened concentrically on a spindle 7. The spindle 7 is caused to rotate by a servomotor 8 with numerical control.

Workpiece 1, work holder 6, spindle 7 and motor 8 (as well as all other parts connected to them and not designated in detail), are arranged on a coordinate device of the machine and can therefore be moved together on mutually perpendicular linear motion axes x and y. The central axis which is common to the work piece 1, the work holder 6, the spindle 7 and the motor 8 coincides with the rotational axis b of the workpiece 1. The central axis which is common to the tool 2, the shaft 3, the spindle 4 and the motor 5 coincides with the rotational axis c of the tool 2 and a tool adjustment axis z (FIG. 1). The linear motion axes x, y and the rotational motion axis b are CNC-controlled, while the rotational movement axis c only has adjustable speed. Axis z is used only to shift the tool 2 with respect to the rotational motion axis c. Since all CNC axes are combined in the work spindle 7, the machine is easily loaded. The workpiece 1 can travel into a predetermined loading and unloading position, so that simple manipulators can also be used for automatic changing of workpieces.

Between the two axes of rotation b and c, a set angle of between 90° and 120° is possible. Thus, the angle $\alpha$ is determined by the machine design and cannot be changed. Preferably, this angle is set at 105° (i.e., when the workpiece axis b is perpendicular, the tool axis c is inclined at an angle of only 15° to the horizontal). At this angle, it is not possible for a collision to occur between the tool spindle or shaft and the rim of the spectacle during the grinding or milling process, even when the surface of the spectacle has very great concave curvature.

The tool spindle 4 with the tool 2 secured to it and the corresponding electric motor 5 (as well as all other parts connected to it and not designated more specifically) can be moved perpendicular to the x-motion axis in order to adjust the tool 2 to the center of the workpiece 1, while maintaining the structurally dictated angle $\alpha$. For this purpose, the adjustable parts are rigidly connected via a bracket 9 to a guide block 10, which is mounted so that it can shift in the mentioned adjustment device on a guide bed 11 of the machine. Between the guide block 10 and the guide bed 11 there is a threaded adjustment spindle 12, which is mounted so that it can turn on the guide bed 11, while being axially immovable, and which also engages with a corresponding threading of the guide block 10.

Figure 3:
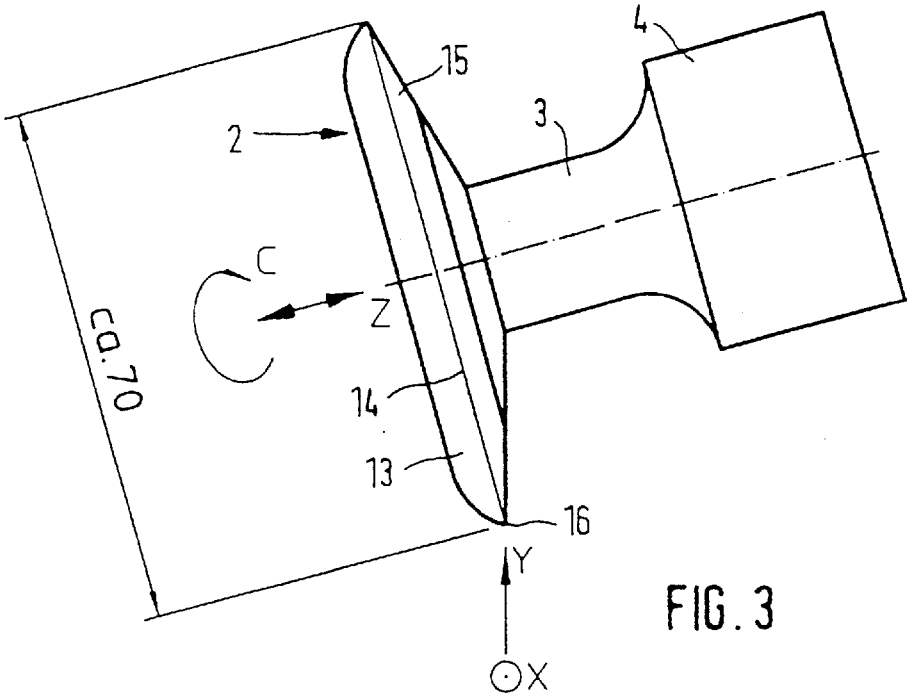
FIG. 3 is a side view of the grinding tool.
Figure 4:
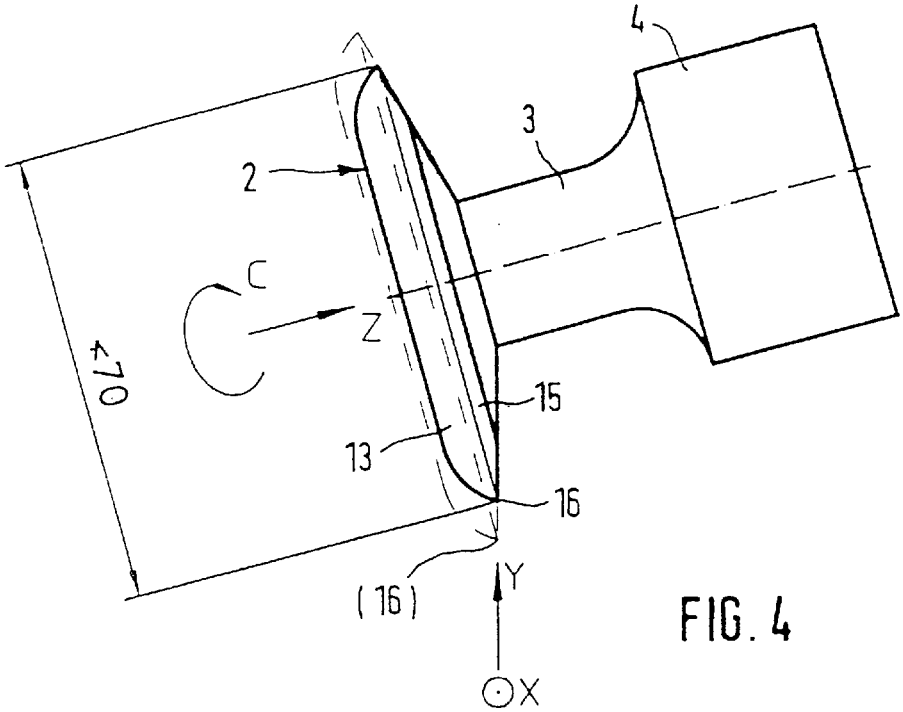
FIG. 4 is a side view of FIG. 3, but after the grinding tool has been used and worn down.

Reference is now made to FIGS. 3 and 4 for a more detailed explanation of the tool 2, configured as a grinding tool. The grinding tool has a disk shape, with an annular grinding lip 13 situated at its circumference. Starting at the end face of the asymmetrically formed grinding lip 13, its radius increases toward the spindle 4, and its maximum radius merges into a circular cutting and shaping edge 14. In order to implement the method, this shaping and cutting edge must be adjusted to the workpiece so that it is directed almost radially toward the center of the workpiece. The back surface 15 of the grinding lip 13, located at the spindle side and merging into the cutting edge 14, is configured such with respect to the structurally dictated angle $\alpha$ that the back surface travels at an angle $\alpha$ to the axis of rotation of the tool c. A perpendicular line through the lowest point 16 of the cutting edge 14 adjoins the back surface 15 as a kind of radial envelope line. The lowest point 16 will always be in the plane of the two axes x and y of linear motion as can be seen by comparing FIGS. 3 and 4. The cutting edge 14 is always determined by the largest radius of the grinding lip and is also always radially directed toward the center of the workpiece as the tool is progressively worn away. FIG. 4 shows, besides the wearing contour indicated by solid lines, also the new contour of the tool in broken lines. As a result of this special tool geometry, the cutting edge constantly sharpens itself during the grinding process, so that the shaping of the surface being machined is not impaired. The lessening of the cutting edge radius as a result of wear can be easily factored into the computer program of the machine.

The material of the grinding lip 13 consists of finely divided diamond particles. The grinding lip 13 may consist of sintered material in which the diamond particles are finely distributed and embedded. Alternatively the finely distributed diamond particles may be galvanically deposited on the annular grinding lip 13.

Figure 5:
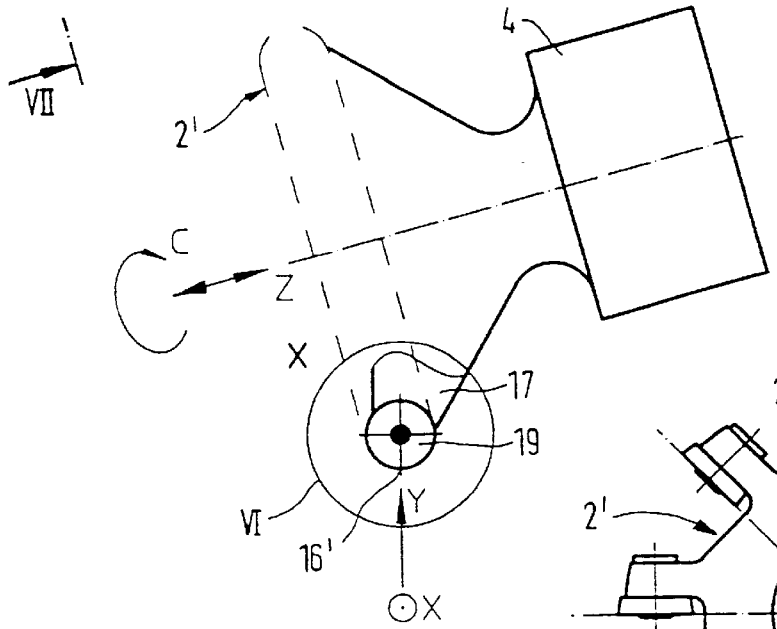
FIG. 5 is a side view of the milling tool.
Figure 7:
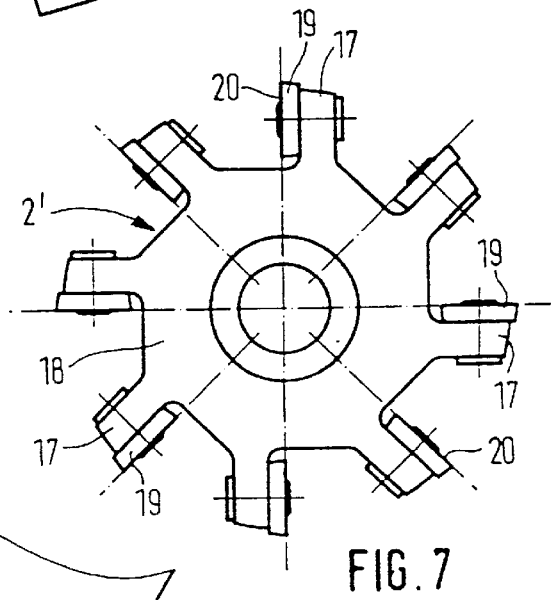
FIG. 7 is a front view of the milling tool, looking in the direction of arrow VII in FIG. 5.
Figure 6:
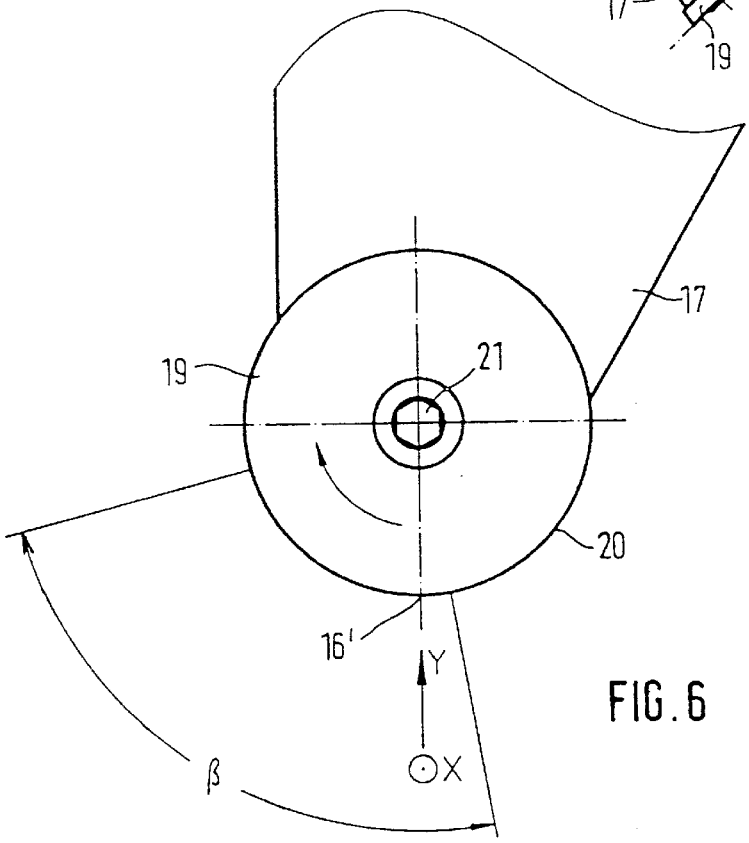
FIG. 6 is a magnified feature of the milling tool of FIG. 5, corresponding to the cutout circle VI.

Reference is now made to FIGS. 5–7 in order to describe the milling cutter 2' provided for machining of plastic. As follows from FIG. 5, the milling cutter 2' is disk-shaped in respect of its form of rotation. For this purpose, the milling cutter 2' is provided with a plurality (in the example shown, eight) of holding arms 17, uniformly distributed about the periphery, which extend outwardly from a central hub piece 18. At the outer ends of the holding arms 17, cutting plates 19 of consistent diameter are secured. The annular blades 20 of the cutting plates 19 are directed radially toward the axis of rotation c of the milling tool 2' and define a toroidal envelope surface, indicated by broken lines in FIG. 5. The toroidal envelope surface is directed radially toward the center of the workpiece in respect of its plane, formed by its largest radius. The lowest point 16' of the toroidal envelope surface will always lie in the plane of the two axes x and y of linear motion.

FIG. 6 shows that the cutting plates 19 are secured to the holding arms 17 by a central screw 21. With the help of the screw 21, the adjusted position of rotation of the cutting plate 19 is set on the holding arm 17. As indicated in FIG. 6 by the angular dimension $\beta$, only an angle of around 90° of the circumference of the annular blade 20 is utilized for the milling process, i.e., only around a quarter of the circumference of the annular blade is used for the milling process. This means that, after the first sector of the annular blade is worn down, the cutting plates 19 can still be rotated three times into a new position.

Reference is now made to FIGS. 8–11 for a closer explanation of the process sequence. This process sequence encompasses all possible machining processes, namely, the rim machining process (FIG. 8), the faceting step (FIG. 9), the plunge-cut step (FIG. 10), and the step with machining along the spiral path (FIG. 11), which concludes the machining of the surface in the context of the present method. The views on the right side of FIGS. 8, 9, 10 and 11 indicate the relative movement of the center of the tool with respect to the workpiece in broken lines. In fact, however, it is not the tool which moves relative to the workpiece, but rather the workpiece which moves relative to the tool.

The process shall be depicted on the example of the machining of a rough blank 1 for eyeglasses on a brittle-hard material, using a grinding tool 2. The machining of a rough plastic blank with a milling tool is done with similar methods using the milling cutler 2'. The process steps of rim machining (FIG. 8) and faceting (FIG. 9) are events which can occur anywhere in the process sequence, although it is preferable for them to be simultaneous. FIGS. 8–11 show the preferred sequence of process steps adopted. The axes x, y, b and c, shown symbolically only in FIG. 8, apply to all FIGS. 8–10.

Figure 8:
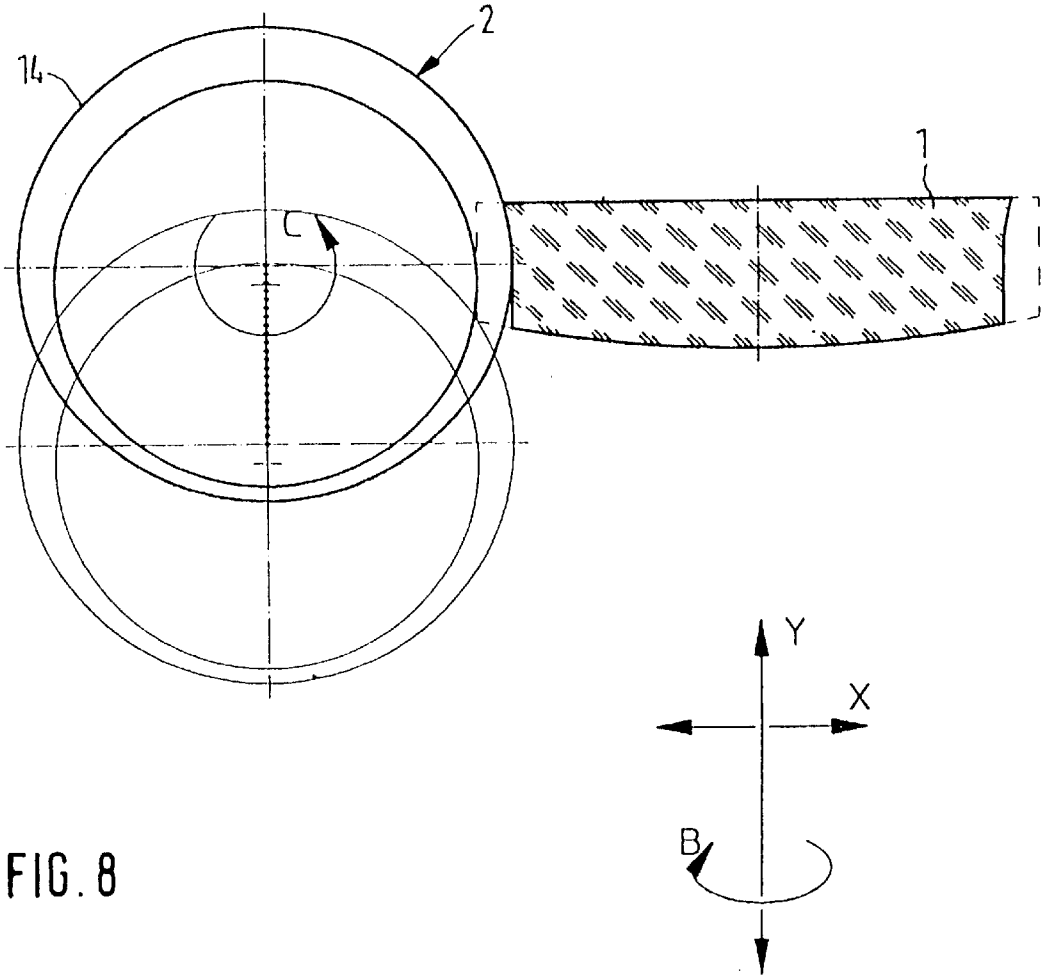
FIG. 8 shows the tool and workpiece during the rim machining step, in two views, namely, with a side view and the front view of the tool.
Figure 8:
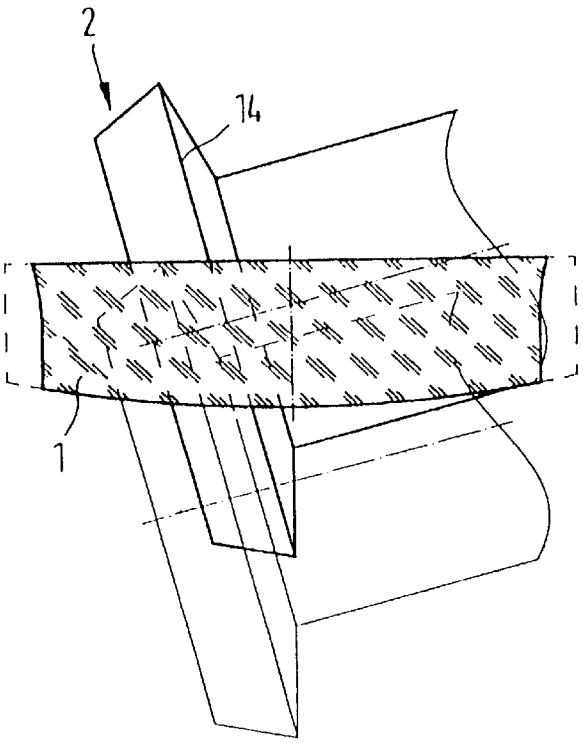

Referring to FIG. 8, the workpiece 1 is first brought up to the tool 2 by a sideways movement along the x-axis, whereupon the workpiece 1 is moved on the y-axis with respect to the tool 2, (which always remains stationary) until the workpiece 1 is situated at roughly the same height as the tool axis and the edge of the workpiece touches the circular cutting edge 14. With the workpiece 1 so positioned, the tool 2 and workpiece 1 are rotated about their axes of rotational movement c and b, respectively, to remove material from the edge of the workpiece. By additional lateral movement of the workpiece 1 on the x-axis and continuous feeding movement on the y-axis, the rough blank is machined to the peripheral contour dictated by the shape of the eyeglass frame. As the workpiece 1 is fed on the y-axis, the tool 2 engages with the rim of the workpiece approximately in the manner of a helical line.

After preparing the peripheral contour, the upper edge of the workpiece circumference is faceted by means of the tool. (See FIG. 9) This work step occurs in continuous sequence with the other work steps under constant rotation of workpiece and tool. In this process, depending on the extent and the direction of the desired faceting, the workpiece 1 is both moved up further to the tool 2 on the x-axis and, in a motion superimposed on this, the workpiece moves downward on the y-axis until the desired facet surface 22 is achieved.

In a further continuous sequence of work steps, under constant rotation of workpiece and tool about the respective axes of rotation, the workpiece 1 is further moved relative to the tool 2 during the plunge-cut step by coordinated, program-controlled movement on the x and y axes, until tool and workpiece assume the relative position indicated in FIG. 10. In this position of the process sequence, the bulk of the material to be removed is taken off of the blank. This step produces a surface 23 in the shape of an annular trough, as closely adapted as possible to the surface which is to be generated. Furthermore, an outer rim 24 has been achieved, corresponding to the nominal outer contour of the optically active inner surface of the eyeglasses. This completes the plunge-cut step.

Figure 12:
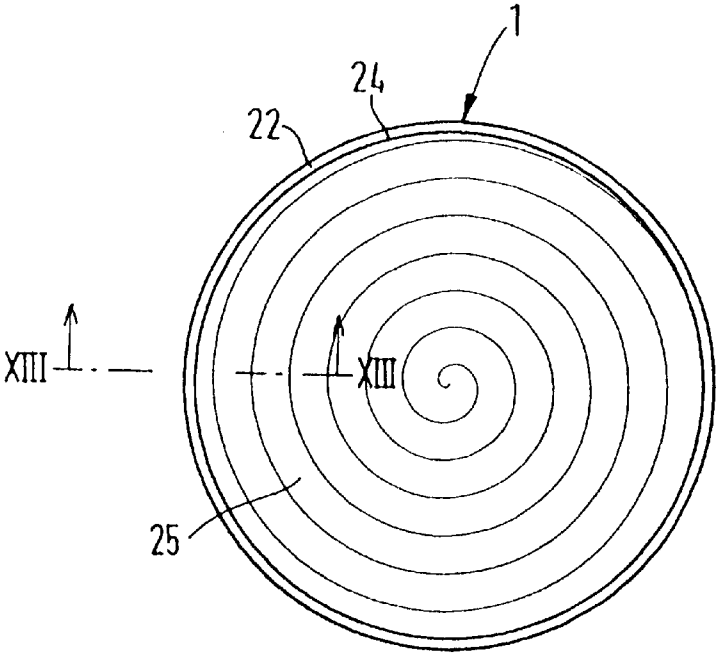
FIG. 12 is a top view of the workpiece after the work step with machining along the spiral path.
Figure 13:
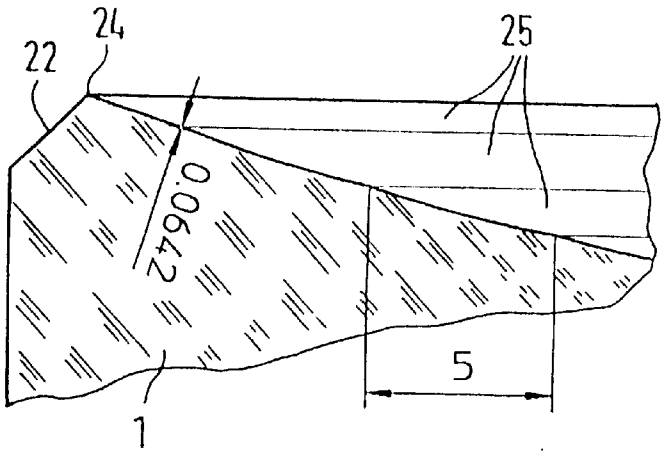
FIG. 13 is a cutaway and magnified section through the workpiece along line XIII—XIII in FIG. 12.

There now follows, again in continuous sequence, the last work step illustrated in FIG. 11, which serves to take off the remainder of the excess material of the blank until the surface is finally shaped. There is a superimposed motion between the workpiece 1 rotating about its axis b and the tool 2, rotating about its c axis but otherwise stationary, in the direction of the x and y axis with a spiral trend of the machining path 25 on the surface being machined, as represented in FIG. 12. In this last work step, the annular trough-shaped surface produced by the plunge-cut step, i.e., the roughly conical central apex of this surface, disappears. Due to the large diameter of the cutting and shaping edge 14 of the tool 2, only a very slight groove is produced on the spiral machining path, i.e., a very low height of the apex above the base of the groove. For example, when the diameter of the cutting edge is 14–70 mm, this dimension is only 0.0642 mm, and the apex spacing is 5 mm. These relationships are shown in FIG. 13. Therefore, after the last process step, i.e., the work step with machining along the spiral path, there results a machined surface which is already so true to shape that the fine grinding and polishing expense after the invented process is slight.

For simplification, the generation of a spherical-concave surface has been illustrated and described. Of course, other surface shapes as mentioned at the outset can also be generated by appropriate program control of the x and y axes.

The above method for creation of a surface from a rough blank for spectacles is suitable for both brittle-hard materials and for plastics. It makes use of a disk-shaped, rotation-symmetrical tool of relatively large diameter, by means of which the material to be taken off the rough blank is removed with high grinding or milling efficiency in at least two work steps, a plunge-cut step and a shaping step with material removed along a spiral path. The outcome of the last work step is a machining path traveling in a spiral from the outside to the inside with low residual apex height and relatively large apex spacing. The resulting surface needs only slight fine-grinding and polishing aftertreatment. As an option, both a rim machining step adapted to the form of the eyeglass frame and a work step faceting the rim of the eyeglasses can be integrated into the method. Furthermore, tools are proposed for carrying out the grinding and milling process.

What is claimed is:

1. A method for creating a concave surface on a rough blank for eyeglasses (workpiece), which already largely corresponds to the inner surface of the finished eyeglass, by means of a milling or grinding tool, during which the blocked-up workpiece and the tool are moved relative to each other in a CNC-controlled machining process with two linear axes of motion (x and y axis) and two axes of rotational movement making an angle ($\alpha$) to each other, the first axis being assigned to the workpiece (b-axis) and the other axis being assigned to the tool (c-axis), in which the removal of material to shape the surface is done along a spiral path on the surface, in that the tool and the workpiece are moved relative to each other along the x, y and b axes, and a disk-shaped rotation-symmetrical tool is used as the tool, being arranged such that the lowest point of the tool in relation to the workpiece is situated in a plane defined by the b and x axes, characterized in that the removal of material along the spiral path is preceded by a plunge-cut step, during which the workpiece rotates about its axis (b) and the tool is moved at least in the direction of the y-axis, until a surface in the shape of an annular trough is achieved, adapted to the concave surface being created at least in the region of the outer rim of the workpiece, so that the surface produced on the workpiece at least in the region of the outer rim corresponds to the nominal outer contour of the optically active inner surface of the eyeglass.

2. The method of claim 1, characterized in that, before the plunge-cut step, the rim of the eyeglass is machined in a rim machining step for adaptation to the contour of the eyeglass frame, during which tool and workpiece are first brought up to each other by lateral relative movement on the x-axis, after which tool and workpiece are moved together by relative movement on the y-axis, until the workpiece is situated at roughly the same height as the tool axis and the edge of the workpiece touches the circular cutting edge of the tool, so that when tool and workpiece rotate about the respective axes of rotational motion (c and b axes), material is removed from the edge of the workpiece, and the rough blank is machined to the peripheral contour specified by the shape of the eyeglass frame by lateral relative movement on the x-axis and continuous feed on the y-axis.

3. The method of claim 2, characterized in that the rim machining step, the plunge-cut step and the machining along the spiral path are carried out in continuous sequence with a single clamping of the workpiece.

4. The method of claim 3, characterized in that, before the plunge-step and possibly after the rim machining process, the upper edge of the workpiece circumference is faceted by means of the tool, the faceting step being carried out in continuous sequence with the other work steps.

5. The method of claim 4, characterized in that the angle ($\alpha$) between the workpiece axis (b) and the tool axis (c) amounts to 105° during all work steps.

* * * * *